US009323274B2

(12) United States Patent
Temkine et al.

(10) Patent No.: US 9,323,274 B2
(45) Date of Patent: Apr. 26, 2016

(54) SELF-CALIBRATING DIGITAL BANDGAP VOLTAGE AND CURRENT REFERENCE

(71) Applicant: ATI Technologies ULC, Markham (CA)

(72) Inventors: Grigori Temkine, Markham (CA); Filipp Chekmazov, Toronto (CA); Oleg Drapkin, Richmond Hill (CA)

(73) Assignee: ATI Technologies ULC, Markham, Ontario (CA)

( * ) Notice: Subject to any disclaimer, the term of this patent is extended or adjusted under 35 U.S.C. 154(b) by 563 days.

(21) Appl. No.: 13/687,182

(22) Filed: Nov. 28, 2012

(65) Prior Publication Data

US 2014/0145701 A1 May 29, 2014

(51) Int. Cl.
*G05F 3/08* (2006.01)
*G05F 3/30* (2006.01)

(52) U.S. Cl.
CPC ..... *G05F 3/30* (2013.01)

(58) Field of Classification Search
CPC ..... G05F 3/225; G05F 3/245; G05F 1/463; G05F 3/267; G05F 3/30; G05F 3/16; G05F 3/20; G05F 3/205; G05F 3/26; H03F 2200/447
USPC ..... 323/313–317
See application file for complete search history.

(56) References Cited

U.S. PATENT DOCUMENTS

| | | | | |
|---|---|---|---|---|
| 6,329,804 | B1 * | 12/2001 | Mercer | G05F 3/30 323/314 |
| 7,543,253 | B2 * | 6/2009 | Marinca | H03F 1/30 323/313 |
| 2008/0122669 | A1 * | 5/2008 | Deken | 341/124 |
| 2012/0326693 | A1 * | 12/2012 | Marten | 323/304 |
| 2013/0015834 | A1 * | 1/2013 | Glibbery | 323/313 |

* cited by examiner

*Primary Examiner* — Harry Behm
*Assistant Examiner* — Peter Novak
(74) *Attorney, Agent, or Firm* — Volpe and Koenig, P.C.

(57) ABSTRACT

A reference voltage generator is provided. In an example, the reference voltage generator includes a temperature-dependent device, a processing module configured to process a digital representations of first and second voltages derived from the temperature-dependent device and a reference voltage to determine a value, and a digital to analog converter (DAC) configured to generate a reference voltage based on the value. The first voltage is proportional to absolute temperature (PTAT) and the second voltage is complementary to absolute temperature (CTAT) and the reference voltage is substantially independent of absolute temperature in an operating temperature range of the reference voltage generator.

21 Claims, 8 Drawing Sheets

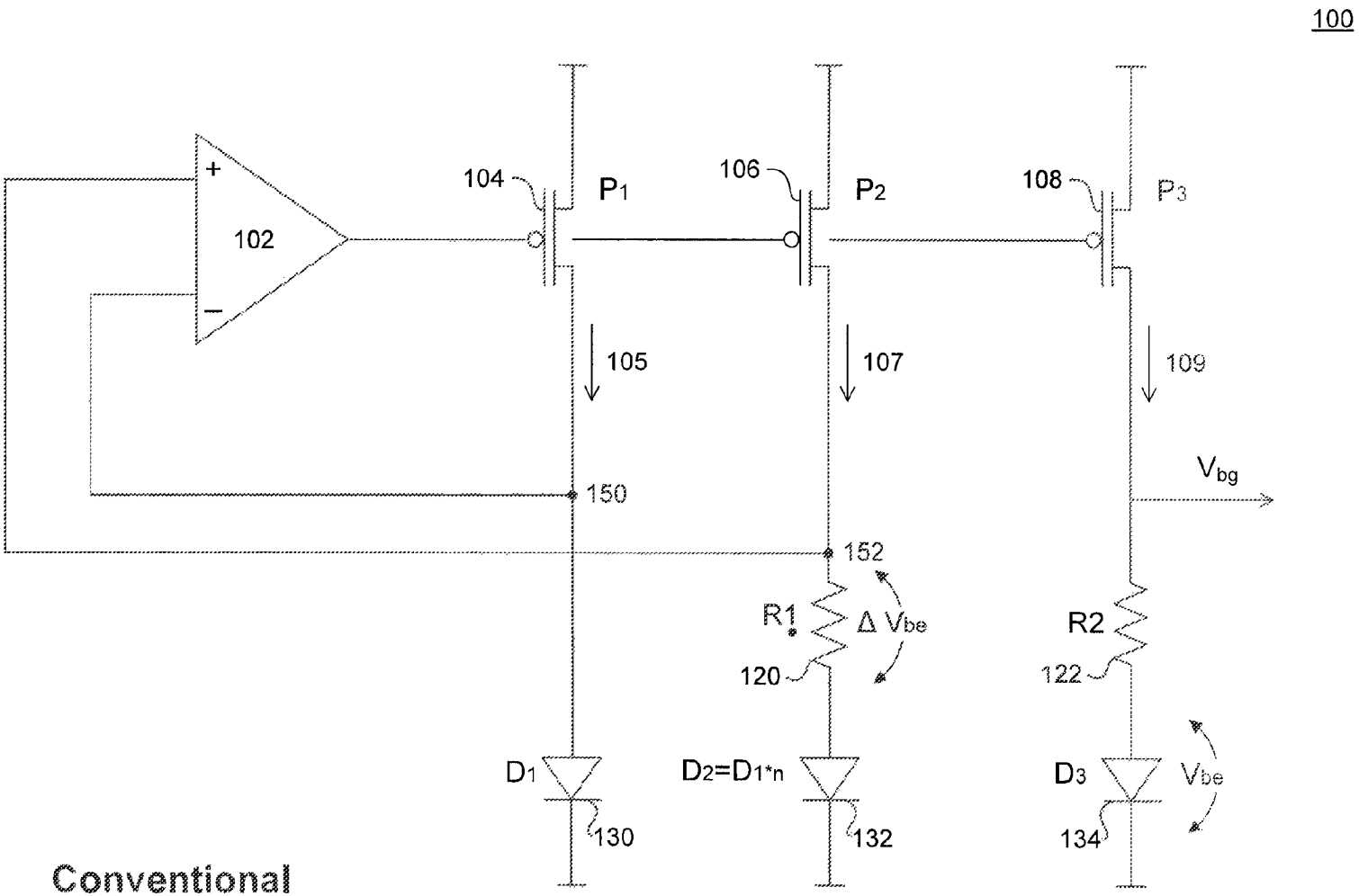
Conventional
FIG. 1

200

700

SELF-CALIBRATING DIGITAL BANDGAP VOLTAGE AND CURRENT REFERENCE

BACKGROUND

1. Field

Embodiments described herein generally relate to reference voltage generators that provide temperature-independent reference voltages.

2. Background

Many integrated circuits (ICs), e.g., application-specific integrated circuits (ASICs), include circuit blocks that require a constant reference voltage to maintain proper operation. A problem arises when even small changes in temperature can cause variance in the actual reference voltage which degrades the performance of the circuit blocks.

A bandgap reference voltage generator is a device that internally compensates for the typical fluctuation of reference voltage with temperature. For example, these generators typically produce the reference voltage which is independent of temperature fluctuations, at least to the first order. However, operation of these generators is dependent on ideal component behavior. In practice, the components are not ideal. Thus, the actual output voltage of the generator can still vary and may deviate from a specific expected value.

Calibration of these generators can be used as a way to obtain ideal component behavior. Calibration, however, can be a time-consuming and expensive process. For example, calibration requires the use of sophisticated testing equipment. This equipment can often be used for a large number of different circuits, thus time spent calibrating reference generators takes away from time that could be used to calibrate other circuits. Moreover, complex calibration techniques needed for sensitive circuits may require especially complex circuitry in the reference voltage generator. Furthermore, a device may have a large number of voltage generators, thereby multiplying the total time and expense associated with calibration.

BRIEF SUMMARY

Some embodiments described herein generally relate to apparatuses, methods, and computer program products used to provide circuits having substantially temperature independent reference voltages without requiring external calibration of the circuits. In some embodiments, a reference voltage generator is provided. The reference voltage generator includes a temperature-dependent device, a processing module configured to process digital representations of first and second voltages derived from the temperature-dependent device and a reference voltage to determine a value, and a digital to analog converter (DAC) configured to generate a reference voltage based on the value. The first voltage is proportional to absolute temperature (PTAT) and the second voltage is complementary to absolute temperature (CTAT) and the reference voltage is substantially independent of absolute temperature in an operating temperature range of the reference voltage generator.

In some embodiments, a method of generating a reference voltage is provided. The method includes determining a value based on digital representations of first and second voltages, and a digital representation of first instance of a reference voltage and generating a second instance of the reference voltage based on the determined value. The first voltage is proportional to absolute temperature (PTAT) and the second voltage is complementary to absolute temperature (CTAT). The reference voltage is substantially independent of absolute temperature in a predetermined temperature range.

In some embodiments, a non-transitory computer readable medium carrying one or more sequences of one or more instructions for execution by one or more processors to perform a method for generating a reference voltage, execution of the instructions by the one or more processors causes the one or more processors to: determine a value based on a digital representations of a first and second voltages, and a digital representation of first instance of a reference voltage and generate a second instance of the reference voltage based on the determined value. The first voltage is proportional to absolute temperature (PTAT) and the second voltage is complementary to absolute temperature (CTAT). The reference voltage is substantially independent of absolute temperature in a predetermined temperature range.

These and other advantages and features will become readily apparent in view of the following detailed description of the invention. Note that the Summary and Abstract sections may set forth one or more, but not all example embodiments of the disclosed subject matter as contemplated by the inventor(s).

BRIEF DESCRIPTION OF THE DRAWINGS/FIGURES

The accompanying drawings, which are incorporated herein and form a part of the specification, illustrate the disclosed subject matter and, together with the description, further serve to explain the principles of the invention and to enable a person skilled in the pertinent art to make and use the invention.

FIG. 1 is a diagram of a conventional bandgap reference circuit, according to some embodiments.

Figure 2:
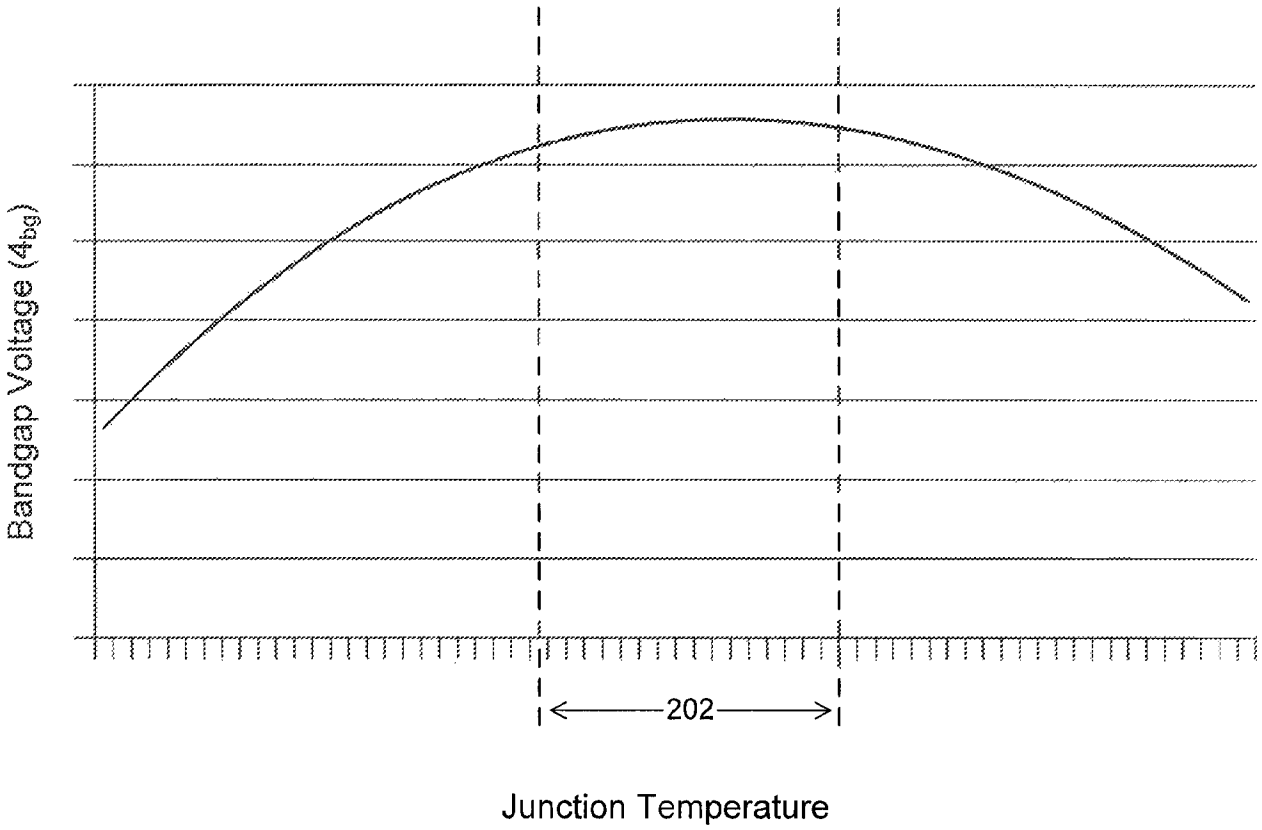
FIG. 2 shows a plot of an ideal bandgap voltage v. junction temperature curve, according to some embodiments.

The disclosed subject matter will now be described with reference to the accompanying drawings. In the drawings, like reference numbers indicate identical or functionally similar elements. Additionally, the left-most digit(s) of a reference number identifies the drawing in which the reference number first appears.

DETAILED DESCRIPTION

I. Introduction

A bandgap reference voltage generator is a device that ideally produces a temperature independent voltage, termed a "bandgap voltage." The reference voltage generator is designed to cancel the variance in voltage that can be caused by varying temperatures to maintain the temperature independent voltage. The bandgap reference voltage can also be independent of supply voltage and/or device variations. The bandgap voltage itself can be provided as the output reference voltage, or the bandgap voltage can be scaled and/or buffered to meet the needs of a particular reference voltage of a device.

FIG. 1 shows a diagram of a conventional bandgap reference voltage generator 100. Reference voltage generator 100 includes an operational amplifier 102, p-type metal oxide semiconductor (PMOS) transistors 104, 106, and 108, resistors 120 and 122, and diodes 130, 132, and 134. PMOS transistors 104, 106, and 108 act as current sources that generate currents 105, 107, and 109, respectively.

Resistors 120 and 122 have resistance values of R1 and R2, respectively. The voltage drop across resistor 120 and diode 134 are labeled in FIG. 1 as $\Delta V_{be}$ and $V_{be}$, respectively. The output reference voltage of reference voltage generator 100, which is also the bandgap voltage, is labeled in FIG. 1 as $V_{bg}$.

The voltage drop across diode 134, $V_{be}$, can be expressed as:

$$V_{be} = V_t * \eta * \ln\left(\frac{I_{d3}}{I_s}\right), \tag{1}$$

where:

$I_{d3}$ is the base-emitter junction current produced by PMOS transistor 108, i.e., current 109, $V_t$ is the thermal voltage, $\eta$ is an ideality factor (e.g., for a diode or a BJT), which is generally approximately equal to 1, but can vary between 1 and 2, and $I_s$ is the reverse bias saturation current, which is dependent on temperature, The thermal voltage, $V_t$, can be expressed as:

$$V_t = k*T/q \tag{2},$$

where:

k is the Boltzmann constant,

T is the absolute temperature of diode 134, and q is the charge of an electron.

Operational amplifier 102 ideally forces the voltages at its positive and negative terminals to be equal. Thus, operational amplifier 102 forces nodes 150 and 152 to the same voltage. Therefore, the voltage drop across resistor 120 can be expressed as:

$$\Delta V_{be} = V_{be1} - V_{be2} = V_t * \eta * \ln\left(\frac{I_{d1}}{I_s}\right) - V_t * \eta * \ln\left(\frac{I_{d2}}{I_s}\right), \tag{3}$$

where:

$I_{d1}$ and $I_{d2}$ are the currents produced by PMOS transistors 104 and 106, respectively, i.e., currents 105 and 107, respectively.

In some embodiments, PMOS transistors 104, 106, and 108 are substantially equally sized. In this implementation, therefore, currents 105, 107, and 109 are substantially equal. This current is referred to as $I_{PTAT}$ (the term "PTAT" described in greater detail above in the summary and below).

In some embodiments, diode 132 has n times as many PN junctions as do diodes 130 and 134. Thus, when currents 105 and 107 are equal, each PN junction instance in diode 132 passes a current that is n times smaller than the corresponding PN junction of diode 130. Therefore, the voltage drop across resistor 120, $\Delta V_{be}$, can be expressed as:

$$\Delta V_{be} = V_{be1} - V_{be2} = V_t * \eta * \ln\left(\frac{I_{PTAT}}{I_s}\right) - V_t * \eta * \ln\left(\frac{I_{PTAT}}{I_s * n}\right) \tag{4}$$

-continued $$= V_t * \eta * \ln(n).$$

Because n is temperature independent and $\eta$'s dependence on temperature is weak, the only temperature-sensitive variable that determines the value of $\Delta V_{be}$ is $V_t$. As shown in Equation (2), $V_t$ increases with the absolute temperature of diode 134. It follows, therefore, that $\Delta V_{be}$ rises with temperature. Accordingly, $\Delta V_{be}$ is referred to as being a proportional to absolute temperature (PTAT) voltage. In some embodiments, the dependence of $\Delta V_{be}$ on temperature is in the range of 100 μV to 200 μV per 1 degree Kelvin (K).

The current passing through resistor 120 (ignoring the effects of temperature on a value of resistor 120) can be expressed as:

$$I_2 = I_{PTAT} = V_t * \eta * \ln(n)/R1 \tag{5}.$$

Thus, the output reference voltage of reference voltage generator 100, $V_{bg}$ can be expressed as:

$$V_{bg} = V_{be} + I_{d3} * R2 = V_{be} + V_t * \eta * R2 \ln\frac{(n)}{R1} = V_{be} + \Delta V_{be} * \left(\frac{R2}{R1}\right). \tag{6}$$

As noted above, voltage $\Delta V_{be}$ increases with temperature and therefore is a PTAT voltage. In contrast, voltage $V_{be}$ decreases with temperature and therefore is termed complementary to absolute temperature (CTAT). For example, using a first order approximation, $V_{be}$ linearly decreases with temperature at the rate of approximately 1.6 to 2.0 mV per 1 degree K.

$V_{be}$ decreases with temperature because of the complex dependence of the reverse bias current $I_s$ on temperature. In particular. $I_s$ has a components that is exponentially dependent on temperature and another that is a function of $T^4$. Because $V_{be}$ is a function of ln $$\left(\frac{I_{d3}}{I_5}\right),$$

the temperature dependence of $I_s$ results in $V_{be}$ being a CTAT value.

Thus, the output of reference voltage generator 100, $V_{bg}$, as expressed in Equation (6) above, is a sum of PTAT and CTAT voltages. Therefore, to obtain temperature independent voltage output, the ratio between the value of resistor 122 (R2) and the value of resistor 120 (R1), can be adjusted so that the temperature dependence of the PTAT and CTAT voltages cancel each other out in the anticipated operating range. As would be appreciated by those skilled in the art based on the disclosure herein, this bandgap voltage can be buffered or replicated in other parts of the circuit to provide the desired reference voltage. Moreover, the reference voltage $V_{bg}$ can also be converted into a temperature-independent current reference using a resistor.

FIG. 2 is a plot 200 of an example ideal bandgap voltage $V_{bg}$ versus temperature curve. For example, plot 200 may characterize the ideal behavior of voltage $V_{bg}$ as a function of the temperature of diode 134. As shown in FIG. 2, the curve is approximately constant in central region 202. The location of this relatively flat region can be adjusted by adjusting the values of resistors 122 and 120 such that the PTAT and CTAT components cancel each other out in this temperature range. In particular, the location of the maximum depends on the value of Id3. As such, to determine the location of the maximum, a partial derivative with respect to absolute temperature is computed. As would be appreciated by those skilled in the art based on the description herein, after computing the partial derivative, the location of maximum can be adjusted as a function of the values of resistors 122 and 120.

Thus, in ideal operation, reference voltage generator 100 is able to deliver a substantially temperature independent reference voltage $V_{bg}$ in central region 202. For example, in ideal operation, an R3-to-R2 ratio can be provided such that the flat portion of the curve is located at 70 degrees Celsius (C) and the bandgap voltage is approximately 1.265 V. For example, the bandgap voltage may remain in the range of 1.260-1.265 V at the operating temperature of the ASIC.

The above described ideal operation, however, often does not hold in practice. At least three different sources can contribute to the non-ideal operation of reference voltage generator 100. First, the dependence of the voltage drop across a diode is, in practice, more complex than the approximations presented above. Second, operational amplifier 102 does not, in practice, have infinite gain. Third, there are process mismatches between the various components of reference voltage generator 100. Each of these sources of error is described in further detail below.

In Equation (1) above, the voltage across diode 134 varied as a function of ln $$\left(\frac{I_{d3}}{I_s}\right).$$

This exponential dependence on the reverse bias saturation current, $I_S$, however, is only a first order approximation. In practice, for a given temperature and a given solid state semiconductor device (e.g., a BJT transistor or a diode), and current $I_{d3}$, there are a unique set of values for the ratio between resistors 122 and 120 that results in temperature-independent operation. Thus, in contrast to the ideal operation depicted in FIG. 2, the complex dependence of the base-emitter voltage on temperature makes it more difficult to choose a ratio between the values of resistors 122 and 120 to provide temperature-independent operation in the temperature range of interest. More specifically, the temperature dependence of the output voltage reference will vary more substantially as a curve through the temperature region of interest. Moreover, referring to FIG. 2, when the ratio between resistors 122 and 120 and/or the current 113 are not precisely set, the curve can tilt upwards or downwards, thereby changing the absolute value of the bandgap reference voltage, $V_{bg}$. Additionally, the asymptote of the curve can shift left or right, also moving the flat region of the curve outside of the intended temperature range.

The finite gain of operational amplifier 102 result in the voltages of nodes 152 and 150 not being equal in practice. Accordingly, Equation (4) must be modified to include an offset as shown below:

$$\Delta V_{be}=V_t*\eta*\ln(n)+V_{OS}=\Delta V_{bei}+V_{OS} \quad (7),$$

where:

$\Delta V_{bei}$ is the ideal voltage across diode 134, and $V_{OS}$ is an offset voltage.

Furthermore, the offset $V_{OS}$ propagates into the output reference voltage $V_{bg}$. Specifically, the modified output reference voltage generator voltage, $V_{bg}$, can be expressed as:

$$V_{bg} = V_{be} + \Delta V_{be} * \left(\frac{R2}{R1}\right) = V_{bgi} + V_{OS} * \left(\frac{R2}{R1}\right), \quad (8)$$

where:

$V_{bgi}$ is the ideal bandgap voltage.

In addition to changing the value of the reference voltage $V_{bg}$, the offset voltage $V_{OS}$ itself is a function of the power supply level, temperature, and other factors. This dependence adds more non-ideal behavior to the operation of reference voltage generator 100. Therefore, the value of the output reference voltage is a function of the processes used to create its circuitry, particularly operational amplifier 102, as well as the DC level of the supply voltage used during operation. One way to reduce the offset $V_{OS}$ is to increase the gain of operational amplifier 102. Increasing the gain of operational amplifier 102, however, requires making the circuitry of reference voltage generator 100 more intricate and requires additional stability compensation to be present in the overall circuitry.

Device mismatches within reference voltage generator 100 are due to process variations. Mismatches between elements can be considered the most significant source because the mismatches can, depending on the particular mismatch, impact the absolute value of voltage output $V_{bg}$, its temperature dependence, or both. For example, the mismatch between diodes 130, 132, and 134 can impact both the DC level of the output reference voltage $V_{bg}$ and its temperature performance. Moreover, the PMOS transistors 104, 106, 108 mismatch also can affect the absolute value of output reference voltage $V_{bg}$, its temperature performance, or both.

The input voltage to operational amplifier 102 may be offset due to device mismatches within operational amplifier 102. This mainly affects the DC offset of the output reference voltage $V_{bg}$. Similar to the offset $V_{OS}$ described above, this offset propagates to the output reference voltage $V_{bg}$. The value of this offset can be orders of magnitude larger than the offset $V_{OS}$. The mismatch between resistors 122 and 120 also can affect both the absolute value of reference voltage $V_{bg}$ and its temperature performance. If both resistor values scale in unison with the process, the output reference voltage $V_{bg}$ DC level is affected.

Thus, while reference voltage generator 100 is designed to produce a temperature-independent reference voltage, the analog nature of the circuits included therein introduces both changes to the absolute value of the output voltage and its temperature dependence. In fact, if reference voltage generator 100 is uncalibrated, the output reference voltage can vary by up to +/− ten percent. Moreover, depending on the severity of the mismatches within reference voltage generator 100, the reference can also vary with temperature by as much as several percent over the device's operating range.

Thus, conventional bandgap reference voltage generators must be calibrated so that they can deliver adequate performance. The number of calibrations per generator depends on the desired accuracy (the accuracy of the generator increases with the number of calibration points). Calibration, however, can be a time-consuming and expensive process. For example, to calibrate reference voltage generator 100, a tester is typically used. The tester allows observation of the reference voltage at specific temperatures via its input/output (I/O) pads. Reference voltage generator 100 can be calibrated until a desired output voltage and at specific temperature range is reached. However, because of the large number of mismatches and their stochastic nature, the calibration and tuning must be performed on a per-part-basis during application-specific integrated circuit (ASIC) production. In addition, in many ASICs, there are multiple instances of bandgap reference voltage generators. The large number of bandgap reference voltage generators on any ASIC further multiplies the time and expense needed to calibrate all reference voltage generators in the ASIC. Furthermore, the tester itself is a sophisticated device and can be used to test a wide range of circuits. Thus, tester-time can be very expensive.

To decrease the time and expense associated with calibrating the reference voltage generator 100, a "one-point" calibration can be used. In such a calibration, the reference voltage generator 100 is only calibrated for a specific temperature point. Although this process reduces the time and expense needed to calibrate reference voltage generator 100, it reduces the accuracy of the calibration.

To increase the accuracy of the calibration procedure, a more complex calibration can be used, e.g., a two- or three-point calibration. The trade-off for the more advanced calibrations is that they take more tester time and require more precise temperature control during the calibration. In fact, because the typical shape of an output reference voltage $V_{bg}$ versus temperature curve (such as the one shown in FIG. 2) resembles a quadratic function, a three-point calibration is often more appropriate when precise calibration is required. Further adding to the expense and time needed to calibrate, when two or three point calibration is used, the architecture of reference voltage generator 100 must be made more complex and more intricate, thereby introducing still more sources for error.

Other techniques can be used to reduce or mitigate the effects of process mismatches. For example, offset cancellation can be implemented using a chopper technique. This technique only partially addresses the problems associated with the non-ideal behavior of the components of reference generator 100 and requires complex analog additions that consume a substantial amount of space on the integrated circuit.

II. Example Embodiments

In embodiments described herein, a reference voltage generator is provided. The reference voltage generator includes a processing module and a digital to analog converter (DAC). The processing module is configured to process digital representations of two voltages and the output reference voltage to determine a value and to generate a control signal based on the value. The DAC is configured to generate a reference voltage based on the control signal. The reference voltage is fed back to the processing module. The first and second voltages are PTAT and CTAT voltages, respectively, and the reference voltage is substantially independent of temperature in the operating temperature range of the reference voltage generator.

For example, the first voltage can be a voltage across a temperature-dependent device (e.g., diode) when a first current is passed therein. The second voltage can be a difference between the first voltage and a voltage drop across the temperature-dependent when a second current is passed therein. In some embodiments, the first and second voltages can be combined using a process-based constant and the value can be a digital representation of the bandgap voltage. Because the values used to generate the digital representation of the bandgap voltage are digital, many of the sources of error present in conventional bandgap reference voltage generators not present.

In some embodiments, a control loop of the processing module generates an error value that is indicative of the deviation from the ideal of the reference voltage. The processing module can further include a digital filtering module that computes a filter output based on the error. The processing module controls the DAC using the filter output to generate a subsequent iteration of the reference voltage. Thus, the control loop operates to calibrate the operation of the reference voltage generator, making the reference voltage generator a self-calibrating device.

Figure 3:
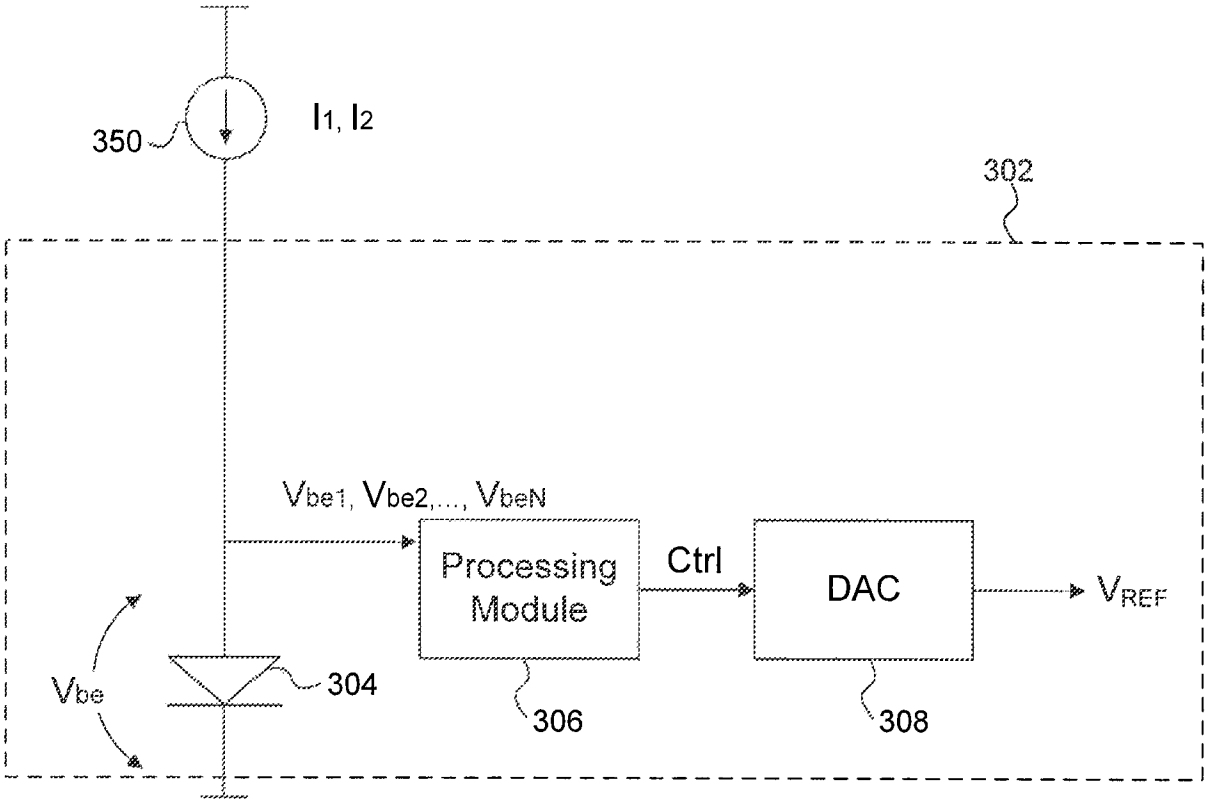
FIGS. 3-4 are diagrams of reference voltage generators, according to some embodiments the disclosed subject matter.

FIG. 3 shows a diagram of a reference voltage generator 302 and a current source 350, according to some embodiments of the disclosed subject matter. Reference voltage generator 302 includes a temperature-dependent device 304, a processing module 306, and a digital-to-analog convertor (DAC) 308.

As shown in FIG. 3, temperature-dependent device 304 is a diode. However, as would be appreciated by those skilled in the art based on the description herein, temperature-dependent device 304 can be other types of elements that have PN junctions, e.g., a bipolar junction transistor (BJT), as well as any non-semiconductor element that has at least one temperature dependable parameter (resistivity, capacitance, etc.) that changes differently at different level of incoming signals (current, voltage, etc.). In some embodiments, several semiconductor elements can be used together with additional circuit block, e.g., an instrumental amplifier, to generate the needed voltages.

In some embodiments, current source 350 is configured to deliver at least two currents I1 and I2. For each of these different currents, there is a different voltage drop, $V_{be}$, across temperature-dependent device 304. The voltage drop across temperature-dependent device 304 is digitized by an analog to digital converter (ADC) of processing module 306 (not shown in FIG. 3, but shown in FIGS. 4 and 6). Processing module 306 is configured to process a feedback voltage reference $V_{REF}$ and a digital representation of two different voltages to determine a value (e.g., the digital representation of the bandgrap voltage). Based on the determined value, digital processing unit 306 can generate a control signal to control DAC 308 to generate the next instance of reference voltage, $V_{REF}$, based on the value.

As noted above, a substantially temperature independent reference voltage can be generated by processing CTAT and PTAT voltages. In the embodiment of FIG. 3, the first voltage received by processing unit 306 can be a PTAT voltage and the second voltage can be a CTAT voltage. In particular, the first digitized voltage can be a digitized version of the PTAT voltage drop across temperature-dependent device 304 when current I1 is passed through therein. The second digitized voltage can be a digitized version of CTAT voltage which is the difference between the voltage drop across temperature-dependent device 304 when current I2 is passed therein and the voltage drop across temperature-dependent device 304 when current I1 is passed therein. This difference is $\Delta V_{be}$ in Equation (9). By processing these two digitized voltages and a predetermined coefficient, a substantially temperature independent reference voltage can be generated. Put another way, processing unit 306 can be configured to determine digitized version of:

$$V_{bg}=V_{be1}+\Delta V_{be}*m=V_{be1}+(V_{be2}-V_{be1})*m \quad (9),$$

where:

m is a technology driven coefficient $V_{be1}$ is the voltage drop across diode 304 when current I1 is passed through therein, and $V_{be2}$ is the voltage drop across diode 304 when current I2 is passed through therein.

Thus, voltage reference generator 302 establishes two distinct values for the voltage drop across temperature-dependent device 304. As described below, in contrast to conventional designs like reference voltage generator FIG. 1 that physically generate their reference voltage using exclusively analog components, the reference voltage generator 302 physically generates its output reference voltage using digital components. The use of digital components obviates the three different sources of error in conventional voltage reference generators mentioned above. Accordingly, the expensive and time consuming calibration procedures needed for analog reference voltage generators can be avoided. A control loop is used to correct for deviations in the output voltage, making the reference voltage generator a self-calibrating device.

In some embodiments, the coefficient, m, is a technology driven constant coefficient that can be determined at design time. This coefficient fixes the temperature range in which the CTAT and PTAT temperature dependence cancels out. It can be predetermined based on the technology used to implement reference voltage generator 302, the current density of temperature-dependent device 304, the current ratio used (i.e., ratio between I1 and I2), and as noted above, the temperature at which compensation is desired.

In some embodiments, additional accuracy in the reference voltage generator can be obtained using additional voltages (i.e., produced by passing different currents through temperature-dependent device 304). For example, N different voltages, corresponding to N different currents generated by current source 350, can be used. In that embodiment, processing module 306 can be configured to determine the bandgap voltage $V_{bg}$ according to:

$$V_{bg}=V_{be1}+\Delta V_{be}*m+F(V_{be1},V_{be2},\ldots,V_{beN}) \quad (10).$$

As would be appreciated by those skilled in the art based on the description herein, the components of reference voltage generator 302 can be implemented as hardware, software, firmware, or a combination thereof. For example, processing module 306 can include both hardware and software components. Alternatively, the operations of processing module 306 can be completed using exclusively software or exclusively hardware.

Figure 4:
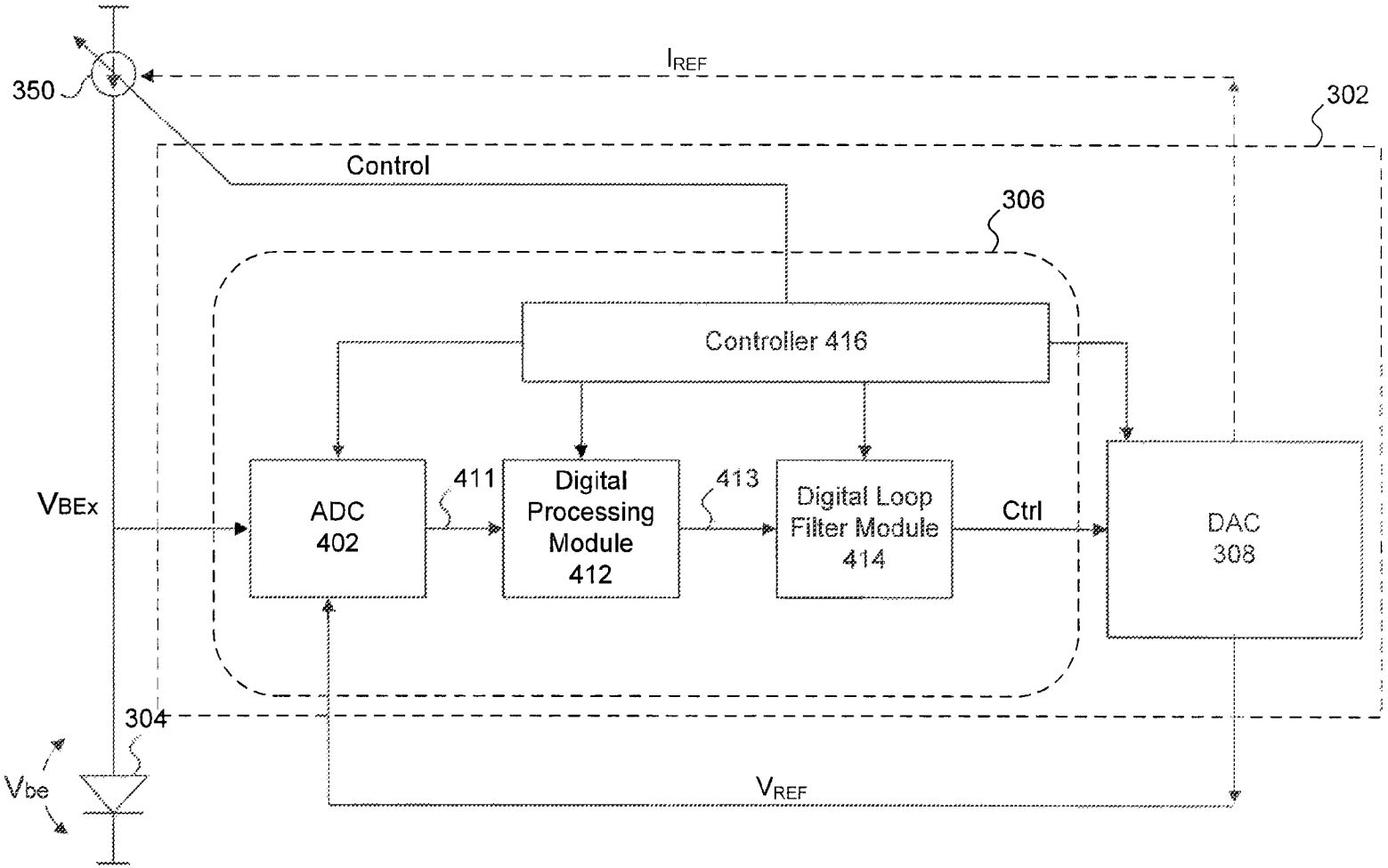

FIG. 4 shows a block diagram of voltage reference generator 302 in greater detail, according to some embodiments of the disclosed subject matter. As shown in FIG. 4, voltage reference generator 302 includes a processing module 306 and a DAC 308. Processing module 306 includes an ADC 402, a digital processing module 412, a digital filter loop module 414, and a controller 416. As described in greater detail below, the voltage drop across temperature-dependent device 304 for different currents can be digitized by ADC 402. In some embodiments, it is assumed that the temperature of temperature-dependent device 304 remains constant during the sampling time of ADC 402. Once the different voltages across temperature-dependent device 304 are digitized, they can be stored for further processing in digital processing module 412. As shown in FIG. 4, digital processing module 412 also receives a feedback of the present instance of $V_{REF}$ generated by DAC 308.

In addition, as noted above, the technology based coefficient, m, can be predetermined and programmed into voltage reference generator 302. Digital processing module 412 generates an output signal based on internally created combination of temperature-dependent signals (e.g., voltages) from temperature-dependent device 304 and the present instance of the voltage reference $V_{REF}$ provided by DAC 308. Digital processing module 412 processes digitized output signals from temperature-dependent device 304 to create temperature independent digitized reference value (e.g., a digitized version of $V_{bg}$ or a digitized version of the output reference voltage, $V_{REF}$). In addition, based on a comparison of the digitized reference value and the feedback voltage reference from DAC 308, the digital processing block 412 computes an error value, which digital loop filter module 414 uses to generate control signals to control DAC 308. DAC 308 output signal $V_{REF}$ will be substantially independent of the temperature in operating temperature range of the reference voltage generator.

Controller 416 can be configured to supervise the operation of the other components of reference voltage generator 302. In some embodiments, controller 416 is configured to control current source 350 to deliver currents I1 and I2. In some embodiments, I2 is four times larger than I1.

ADC 402 can generate digitized values of $V_{be1}$ and $V_{be2}$, termed $N_{be1}$ and $N_{be2}$, according to:

$$N_{be1i}=G_{ADCi}*V_{be1} \quad (11)$$

$$N_{be2i}=G_{ADCi}*V_{be2} \quad (12),$$

where:

$G_{ADCi}$ is the ideal gain of ADC 402.

In addition, the digitized value for the bandgap voltage $V_{bg}$, termed $N_{bg}$, can be expressed as:

$$N_{bgi}=N_{be1i}+m*(N_{be2i}-N_{be1i})=G_{ADCi}*V_{bg}. \quad (13).$$

The subscript i in Equations (11)-(13) indicate that these values assume ideal operation of ADC 402.

Thus, the digital representation of the bandgap voltage reference, $N_{bgi}$, is determined based on the gain of ADC 402. In some embodiments, this digital representation $N_{bgi}$ can be a known constant that can be determined at design time. Moreover, $G_{ADCi}$ is an ideal gain of ADC 402, which is also a known constant. Thus, in the above equations, values $N_{bgi}$, M, $G_{ADCi}$, and $V_{bg}$ are technology dependent and can be determined at design time based on technology parameters and the temperature range in which reference voltage generator 302 will be used.

As noted above, Equations (11)-(13) for determining $N_{bgi}$ assume ideal performance of ADC 402. In practice, ADC 402 may not delivery such ideal operation. Thus, instead of the ideal gain $G_{ADCi}$ ADC 402 can instead supply a real and unknown gain $G_{ADCr}$. Revising Equations (11)-(13) to take this into account:

$$N_{be1r}=G_{ADCr}*V_{be1} \quad (14)$$

$$N_{be2r}=G_{ADCr}*V_{be2} \quad (15),$$

where:

$G_{ADCr}$ is the real gain of ADC 402.

In addition, the real digitized value for the bandgap voltage $V_{bg}$, termed $N_{bg}$, can be determined according to:

$$N_{bgr}=N_{be1r}+m*(N_{be2r}-N_{be1r})=G_{ADCr}*V_{bg}. \quad (16).$$

The subscript r in Equations (14)-(16) indicates that these values are determined based on real operation of ADC 402.

Referring to FIG. 4, digital processing module 412 receives values $N_{be1r}$ and $N_{be2r}$ at node 411. As shown in Equations (14)-(16), $N_{bgr}$, can be computed from values $N_{be1r}$ and $N_{be2r}$. Therefore, the value for $N_{bgr}$ can be computed without actually generating the physical presence of the bandgap voltage reference $V_{bg}$.

Thus, the non-ideal operation of ADC 402 can cause deviations in the absolute reference voltage that is generated by reference voltage generator 302. In some embodiments, the object of voltage reference generator 302 is to generate an ideal voltage reference given by:

$$V_{refi}=K*V_{bg} \quad (17),$$

where:

K is a known constant number, and $V_{refi}$ is the ideal reference voltage.

To generate $V_{refi}$ with an exactly known value, as is desired for highly accurate voltage reference generators, constant K is determined based on the specific processes used to create reference voltage generator 302 and the temperature range in which reference voltage generator 302 will used as well as constants $N_{bgi}$, m, $G_{ADCi}$, and $V_{bg}$. To generate this ideal reference voltage $V_{refi}$, and to compensate for the for the non-ideal gain of ADC 402 and non-ideal operation of the other components of voltage reference generator 302, the actual voltage reference generated by the reference voltage generator 302, $V_{REF}$, can be fed back into reference voltage generator 302 through a control loop. The loop converges on the ideal reference voltage $V_{refi}$. Thus, reference voltage generator 302 operates as a self-calibrating device.

Figure 5:
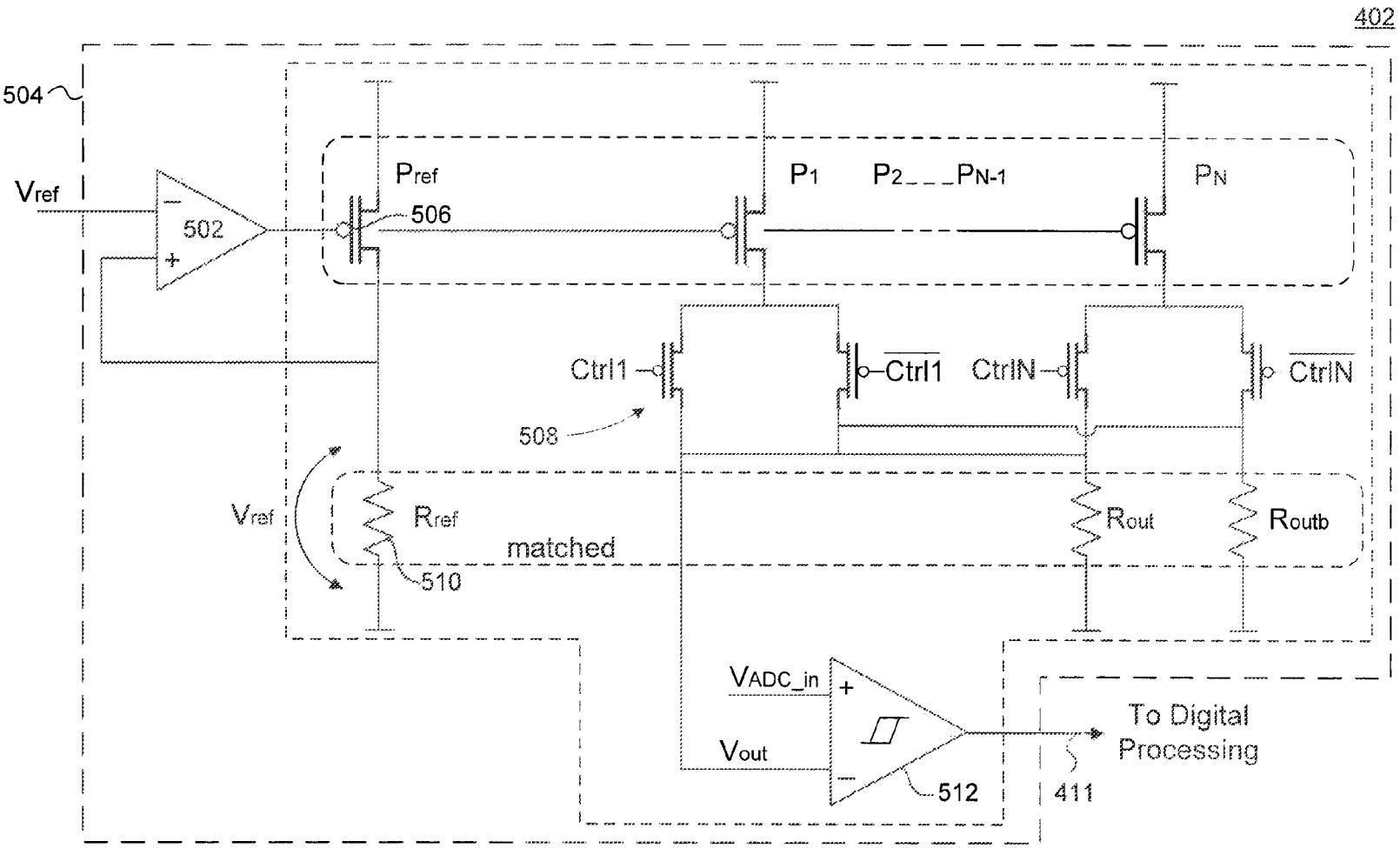
FIG. 5 is a diagram of a portion of an analog to digital converter, according to some embodiments.
Figure 6:
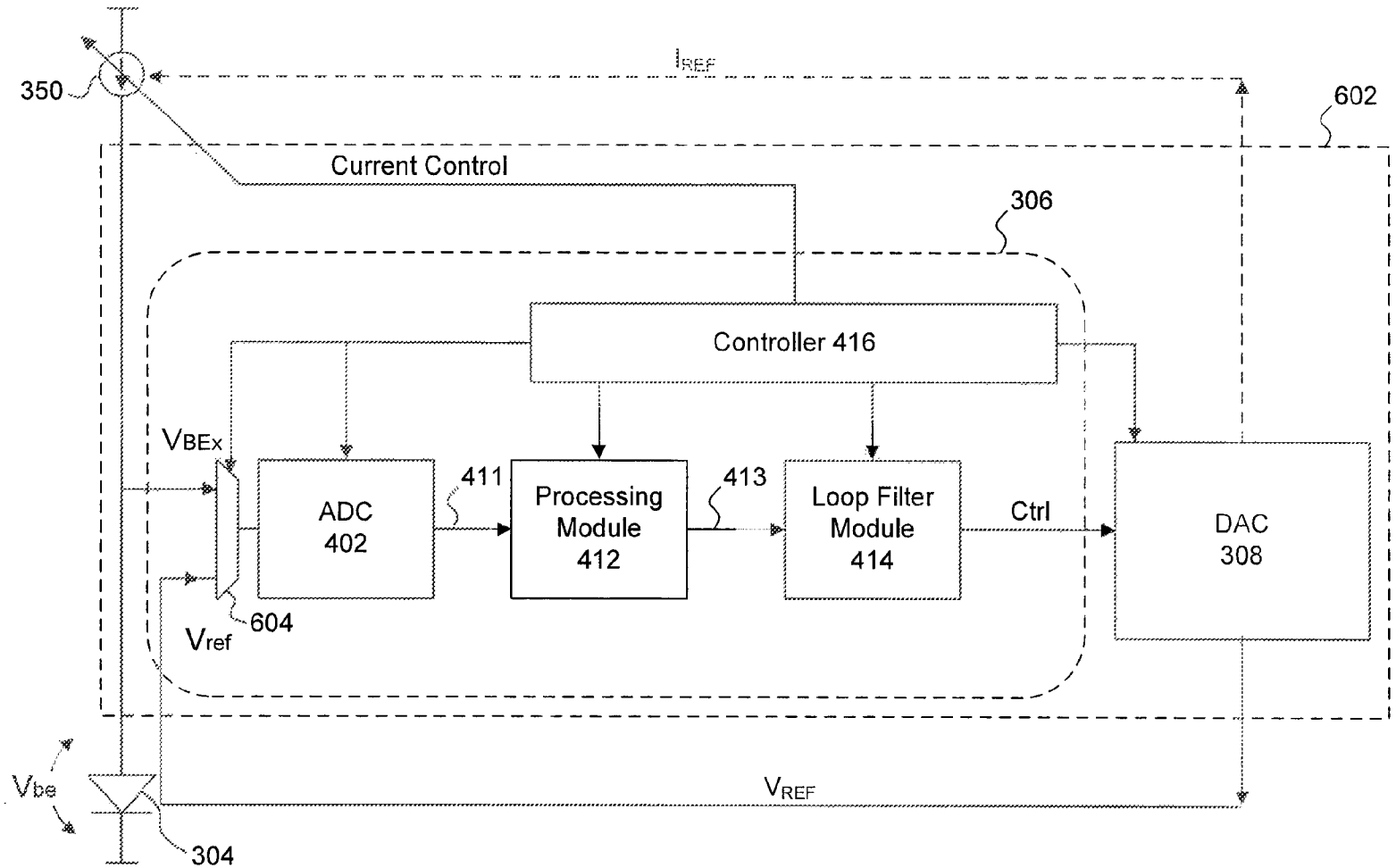
FIG. 6 is a diagram of reference voltage generator, according to some embodiments.

To provide this control loop, digital loop filter module 414 is provided. Digital loop filter 414 provides a way for the error between the ideal reference voltage and the actually generated reference voltage to correct the next iteration of the reference voltage. Those skilled in the art will appreciate that a number of different functions, H(z), can be used for digital loop filter module 414. For example, one filter function that could be used is the value 1. This function however, may not produce sufficient feedback to compensate for errors in reference voltage. In some embodiments, digital filter loop 414 can implement an integrating function, i.e., $H[Z]=1/(1-Z^{-1})$, which is a first order control loop. In some embodiments, recurrent integration can be used where, $H[Z]=H[Z-1]+H_{scale}*\Delta N_{ref}$. As further described below, $\Delta V_{ref}$ is a measure of the error between the ideal reference voltage digitized value and the actual digitized value of the reference voltage. In FIG. 4, digital processing module 412 outputs $\Delta N_{ref}$ at node 413. FIGS. 5 and 6 provide two different evaluation architectures for determining the error between the ideal reference voltage $V_{refi}$ and the actual voltage reference $V_{REF}$.

FIG. 5 shows a diagram of part of ADC 402 that can be used to determine an error value, according to some embodiments of the disclosed subject matter. As described above, deviation from the ideal voltage reference is due in large part to the deviation in the gain of ADC 402 from its ideal gain. In some embodiments, the portion of ADC 402 shown in FIG. 5 can be used to indirectly determine the gain of ADC 402. This gain can be used to generate the error signal needed to correct the voltage reference signal.

As shown in FIG. 5, ADC 402 includes an operational amplifier 502, a DAC 504, and comparators 512. DAC 504 includes matched current sources 506 and differential amplifiers 508. Although FIG. 5 shows a single instance of comparators 512 for simplicity, those skilled in the art will recognize that comparators may be present for each of differential amplifier 508. The output reference voltage $V_{REF}$ is input to the negative terminal of operational amplifier 502. Operational amplifier 502 sets matched current sources 506 of DAC 504 to ensure that the reference voltage $V_{REF}$ is equal to the voltage drop across resistor 510. Therefore, current sources 506 used for the differential amplifiers 508 have a current that is set based on the output reference voltage $V_{REF}$. Those skilled in the art will appreciate, based on the description herein, that the gain of ADC 402 is determined based on the output reference voltage $V_{REF}$ and that comparators 512 are used to compare the voltages across the different terminals in the differential amplifiers 508 to effect a digital-to-analog conversion. Thus, the operation of analog-to-digital convertor 402 remains substantially the same, however, the voltage $V_{REF}$ is used to determine its gain. Thus, the difference between the digital representations of the ideal and real bandgap voltage, $\Delta N_{bg}$, can expressed as:

$$\Delta N_{bg}=N_{bgi}-N_{bgr} \quad (18).$$

The value $\Delta N_{bg}$ can be used as the error value input into digital loop filter module 414 to correct the reference voltage signal, $V_{REF}$. In particular, and as noted above, the value $N_{bgi}$ is known at design time. Thus, digital processing module 412 can implement a subtraction between the digital representation of the ideal bandgap voltage and the actual bandgap voltage to determine the gain of analog-to-digital convertor 402. From this gain, which itself is a function of the reference voltage $V_{REF}$, digital processing module 412 can determine and correct the voltage $V_{REF}$.

FIG. 6 is a block diagram of a voltage reference generator 602, according to some embodiments of the disclosed subject matter. Voltage reference generator 602 is substantially similar to voltage reference generator 302, as shown in FIG. 4, except that the output reference voltage $V_{REF}$ is fed back into ADC 402 through multiplexor 604 for determining the error signal. Specifically, as shown in FIG. 6, controller 416 controls multiplexer 604. Thus, ADC 402 can be used to generate digitized values of both the voltage drops across temperature-dependent device 304 for the different currents and the digitized value for the output reference voltage $V_{REF}$. For example, the output reference voltage digitized value can be represented as:

$$N_{REFr}=G_{ADCr}*V_{REF} \quad (19).$$

The ideal digitized reference voltage can be expressed as:

$$N_{REFi}=G_{ADCr}*V_{REFi}=K*G_{ADCr}*V_{bg}=k*N_{bgr} \quad (20).$$

Thus, in contrast to the embodiment of FIG. 5, in the embodiment of FIG. 6, the output reference voltage $V_{REF}$ is digitized and the error value is determined as the difference between the digitized values for the actual and ideal reference voltages. More specifically, the error signal can be generated as:

$$\Delta N_{REF}=N_{REFi}-N_{REFr} \quad (21).$$

As it will be appreciated by those skilled in the art based on the description herein, the examples for error evaluation is shown in FIGS. 5 and 6 are purely illustrative. Those skilled in the art, based on the description herein, will appreciate that other architectures can be used to determine the error value used to correct the voltage reference signal.

As noted above, the current generated by current source 350 is assumed to be largely temperature-independent and accurate. However, in some sensitive applications, e.g., temperature sensing or video processing, a current source 350 may have to be calibrated. To effect such a calibration, the calibrated voltage $V_{REF}$ or its derivative, can be used for current calibration using a precise external resistor as a voltage to current converter. The voltage reference generator can then recalibrate the voltage reference $V_{REF}$ using the refined current. This process can be repeated as necessary, depending on the desired error reduction. Thus, convergence of the control loop of the reference voltage generator calibrates both the reference voltage and the current source. In practice, calibrating the current source in this manner can reduce error in the reference voltage by approximately 3 mV or 4 mV.

To correct for higher order effects, the architecture shown in FIGS. 3-6 can again be used. In particular, the digitized end voltages for the voltage drops across diode 304 can be used as an indication of the temperature of the larger ASIC. This temperature value can then be used to further reduce the temperature variations of the output reference $V_{REF}$.

Figure 7:
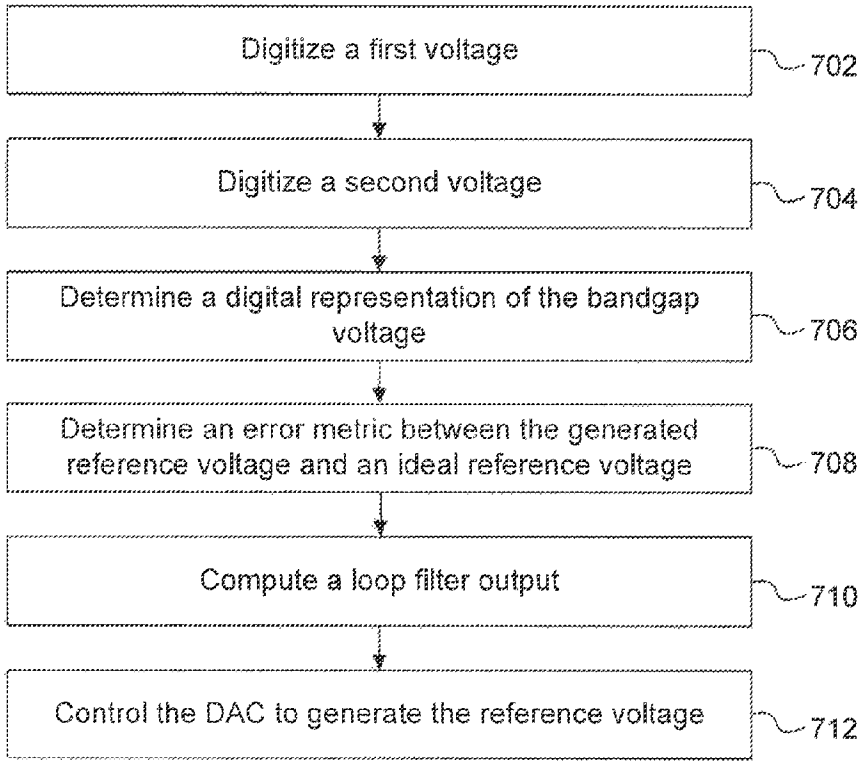
FIG. 7 is a flowchart of a method of generating a reference voltage, according to some embodiments.

FIG. 7 shows a flowchart depicting a method 700 for generating a reference voltage, according to some embodiments of the disclosed subject matter. In one example, method 700 may be performed by the systems shown in FIGS. 2-6. Not all steps may be required, nor do all the steps shown in FIG. 7 necessarily have to occur in the order shown.

In step 702, a first voltage is digitized. In step 704, a second voltage is digitized. For example, as described above, the first voltage can be a voltage across a temperature-dependent device when a first current is passed therein and the second voltage can be the difference between the first voltage and the voltage across the temperature-dependent device when a second voltage is passed therein. The first and second voltages can be PTAT and CTAT voltages, respectively.

In step 706, a digital representation of a value is determined. For example, the digital representation of the bandgap voltage can be determined according to Equation (16).

In step 708, an error value between the generated voltage and an ideal reference voltage is determined. For example, the error value can be generated using Equation (18) or (21).

In step 710, a loop filter output is determined. As noted above, those skilled in the art based on the description herein will recognize that a number of different types of loop filters can be used for correcting the reference of the voltage. For example, a recurrent integration given by $H[Z]=H[Z-1]+H_{scale}*\Delta N_{ref}$, where $\Delta N_{ref}$ is the error value can be used.

In step 712, the loop filter output is used to control the DAC to generate the reference voltage. For example, in FIG. 4, digital filter loop module 414 outputs a control signal to DAC 308 that adjusts the output voltage $V_{REF}$ accordingly.

Figure 8:
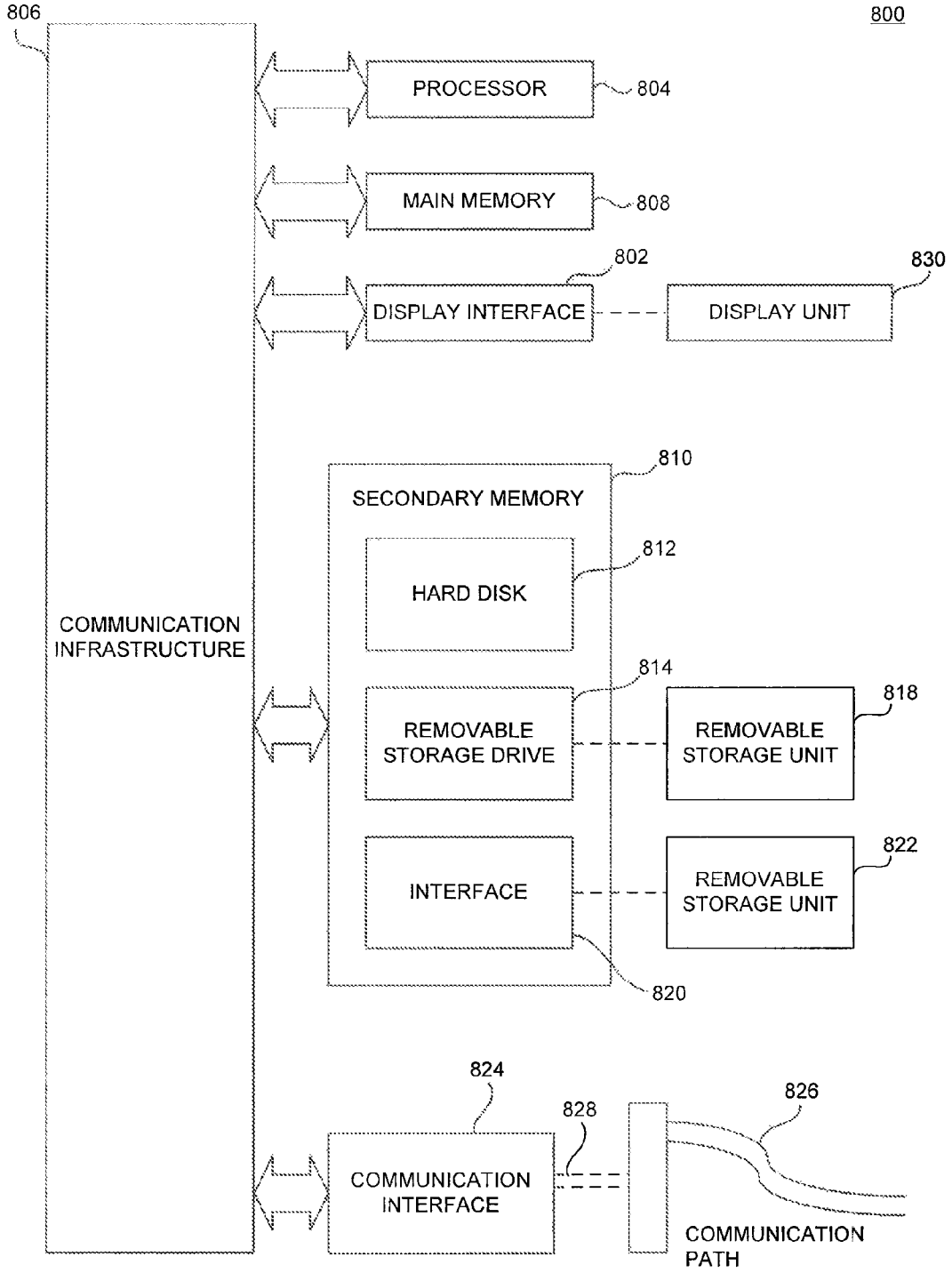
FIG. 8 illustrates an example computer system in which embodiments of reference voltage generation, or portions thereof, may be implemented as computer-readable code.

FIG. 8 illustrates an example computer system 800 in which embodiments, or portions thereof, may be implemented as computer-readable code. For example, digital processing unit 306 or portions thereof can be implemented in computer system 800 using hardware, software, firmware, tangible computer readable media having instructions stored thereon, or a combination thereof and may be implemented in one or more computer systems or other processing systems. Hardware, software, or any combination of such may embody any of the modules and components in FIGS. 3-6.

If programmable logic is used, such logic may execute on a commercially available processing platform or a special purpose device. One of ordinary skill in the art may appreciate that embodiments of the disclosed subject matter can be practiced with various computer system configurations, including multi-core multiprocessor systems, minicomputers, mainframe computers, computer linked or clustered with distributed functions, as well as pervasive or miniature computers that may be embedded into virtually any device.

For instance, at least one processor device and a memory may be used to implement the above described embodiments. A processor device may be a single processor, a plurality of processors, or combinations thereof. Processor devices may have one or more processor "cores."

Various embodiments are described in terms of this example computer system 800. After reading this description, it will become apparent to a person skilled in the relevant art how to implement embodiments using other computer systems and/or computer architectures. Although operations may be described as a sequential process, some of the operations may in fact be performed in parallel, concurrently, and/or in a distributed environment, and with program code stored locally or remotely for access by single or multi-processor machines. In addition, in some embodiments the order of operations may be rearranged without departing from the spirit of the disclosed subject matter.

Processor device 804 may be a special purpose or a general purpose processor device. As will be appreciated by persons skilled in the relevant art, processor device 804 may also be a single processor in a multi-core/multiprocessor system, such system operating alone, or in a cluster of computing devices operating in a cluster or server farm. Processor device 804 is connected to a communication infrastructure 804, for example, a bus, message queue, network, or multi-core message-passing scheme.

Computer system 800 also includes a main memory 808, for example, random access memory (RAM), and may also include a secondary memory 810. Secondary memory 810 may include, for example, a hard disk drive 812, removable storage drive 814. Removable storage drive 814 may comprise a floppy disk drive, a magnetic tape drive, an optical disk drive, a flash memory, or the like. The removable storage drive 814 reads from and/or writes to a removable storage unit 818 in a well known manner. Removable storage unit 818 may comprise a floppy disk, magnetic tape, optical disk, etc. which is read by and written to by removable storage drive 814. As will be appreciated by persons skilled in the relevant art, removable storage unit 818 includes a computer usable storage medium having stored therein computer software and/or data.

In some embodiments, secondary memory 810 may include other similar means for allowing computer programs or other instructions to be loaded into computer system 800. Such means may include, for example, a removable storage unit 822 and an interface 820. Examples of such means may include a program cartridge and cartridge interface (such as that found in video game devices), a removable memory chip (such as an EPROM, or PROM) and associated socket, and other removable storage units 822 and interfaces 820 which allow software and data to be transferred from the removable storage unit 822 to computer system 800.

Computer system 800 can include a display interface 832 for interfacing a display unit 830 to computer system 800. Display unit 830 can be any device capable of displaying user interfaces according to this invention, and compatible with display interface 832. Examples of suitable displays include liquid crystal display panel based device, cathode ray tube (CRT) monitors, organic light-emitting diode (OLED) based displays, and touch panel displays. For example, computing system 500 can include a display 830 for displaying graphical user interface elements.

Computer system 800 may also include a communications interface 824. Communications interface 824 allows software and data to be transferred between computer system 800 and external devices. Communications interface 824 may include a modem, a network interface (such as an Ethernet card), a communications port, a PCMCIA slot and card, or the like. Software and data transferred via communications interface 824 may be in the form of signals, which may be electronic, electromagnetic, optical, or other signals capable of being received by communications interface 824. These signals may be provided to communications interface 824 via a communications path 826. Communications path 826 carries signals and may be implemented using wire or cable, fiber optics, a phone line, a cellular phone link, a radio-frequency (RF) link or other communications channels.

Auxiliary I/O device interface 834 represents general and customized interfaces that allow processor device 804 to send and/or receive data from other devices 836, such as microphones, touch-sensitive displays, transducer card readers, tape readers, voice or handwriting recognizers, biometrics readers, cameras, portable mass storage devices, and other computers. Device interface 834 may perform signal conditioning and processing functions such as analog to digital and digital to analog conversion, amplification and filtering of device generated signals, and generation of hand-shaking signals to coordination the operation of devices 836 with the operations of computer system 800.

In this document, the terms "computer program medium" and "computer readable medium" are used to generally refer to storage media such as removable storage unit 818, removable storage unit 822, and a hard disk installed in hard disk drive 812. Computer program medium and computer usable medium may also refer to memories, such as main memory 808 and secondary memory 810, which may be memory semiconductors (e.g. DRAMs, etc.).

Computer programs (also called computer control logic) are stored in main memory 808 and/or secondary memory 810. Computer programs may also be received via communications interface 824. Such computer programs, when executed, enable computer system 800 to implement embodiments as discussed herein. In particular, the computer programs, when executed, enable processor device 804 to implement the processes of embodiments, such as the stages of the methods illustrated by flowchart 700 Accordingly, such computer programs can be used to implement controllers of the computer system 800. Where embodiments are implemented using software, the software may be stored in a computer program product and loaded into computer system 800 using removable storage drive 814, interface 820, and hard disk drive 812, or communications interface 824.

Embodiments also may be directed to computer program products comprising software stored on any computer readable medium. Such software, when executed in one or more data processing devices, causes a data processing device(s) to operate as described herein. For example, the software can cause data processing devices to carry out the steps of flowchart 700 shown in FIG. 7.

Embodiments employ any computer useable or readable medium. Examples of tangible, computer readable media include, but are not limited to, primary storage devices (e.g., any type of random access memory), secondary storage devices (e.g., hard drives, floppy disks, CD ROMS, ZIP disks, tapes, magnetic storage devices, and optical storage devices, MEMS, nano-technological storage device, etc.). Other computer readable media include communication mediums (e.g., wired and wireless communications networks, local area networks, wide area networks, intranets, etc.).

For example, in addition to implementations using hardware (e.g., within or coupled to a Central Processing Unit ("CPU"), microprocessor, microcontroller, digital signal processor, processor core, System on Chip ("SOC"), or any other programmable or electronic device), implementations may also be embodied in software (e.g., computer readable code, program code, instructions and/or data disposed in any form, such as source, object or machine language) disposed, for example, in a computer usable (e.g., readable) medium configured to store the software. Such software can enable, for example, the function, fabrication, modeling, simulation, description, and/or testing of the apparatus and methods described herein. For example, this can be accomplished through the use of general programming languages (e.g., C, C++), GDSII databases, hardware description languages (HDL) including Verilog HDL, VHDL, SystemC, SystemC Register Transfer Level (RTL), and so on, or other available programs, databases, and/or circuit (i.e., schematic) capture tools. Such software can be disposed in any known computer usable medium including semiconductor, magnetic disk, optical disk (e.g., CD-ROM, DVD-ROM, etc.) and as a computer data signal embodied in a computer usable (e.g. readable) transmission medium (e.g., carrier wave or any other medium including digital, optical, or analog-based medium). As such, the software can be transmitted over communication networks including the Internet and intranets.

It is understood that the apparatus and method embodiments described herein may be included in a semiconductor intellectual property core, such as a microprocessor core (e.g., embodied in HDL) and transformed to hardware in the production of integrated circuits. Additionally, the apparatus and methods described herein may be embodied as a combination of hardware and software. Thus, the present invention should not be limited by any of the above-described exemplary embodiments, but should be defined only in accordance with the following claims and their equivalence.

Embodiments of the disclosed subject matter have been described above with the aid of functional building blocks illustrating the implementation of specified functions and relationships thereof. The boundaries of these functional building blocks have been arbitrarily defined herein for the convenience of the description. Alternate boundaries can be defined so long as the specified functions and relationships thereof are appropriately performed.

The foregoing description of the specific embodiments will so fully reveal the general nature of the invention that others can, by applying knowledge within the skill of the art, readily modify and/or adapt for various applications such specific embodiments, without undue experimentation, without departing from the general concept of the disclosed subject matter. Therefore, such adaptations and modifications are intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance.

The breadth and scope of the disclosed subject matter should not be limited by any of the above-described example embodiments, but should be defined only in accordance with the following claims and their equivalents.

What is claimed is:

1. A reference voltage generator, comprising:

a temperature-dependent device;

a processing device comprising circuitry configured to process a reference voltage and digital representations of first and second voltages, the first and second voltages being derived from the temperature dependent device, and to output a value;

a digital to analog converter (DAC) comprising circuitry configured to generate the reference voltage based on the value;

wherein the first voltage is proportional to absolute temperature (PTAT) and the second voltage is complementary to absolute temperature (CTAT), and wherein the reference voltage is substantially independent of absolute temperature in an operating temperature range of the reference voltage generator; and wherein the reference voltage is fed back from the DAC to the processing device.

2. The reference voltage generator of claim 1, wherein the temperature-dependent device comprises:

a solid-state semiconductor device having first and second terminals, wherein the first voltage is a voltage drop across the first and second terminals when the solid-state semiconductor device receives a first current, and wherein the second voltage is a difference between (1) a voltage drop across the first and second terminals when the solid-state semiconductor device receives a second current and (2) the first voltage.

3. The reference voltage generator of claim 2, wherein the solid-state semiconductor device comprises a PN junction.

4. The reference voltage generator of claim 3, wherein the solid-state semiconductor device comprises a diode or a bipolar junction transistor (BJT).

5. The reference voltage generator of claim 2, wherein the solid-state semiconductor device comprises a bipolar junction transistor (BJT).

6. The reference voltage generator of claim 2, wherein the processing device comprises a controller configured to control a current source to produce the first and second currents.

7. The reference voltage generator of claim 1, wherein the processing device is configured to determine the value according to:

$$N_{bg}=N_{be1}+m*\Delta N_{be},$$

wherein:

$N_{be1}$ is the digital representation of the first voltage;

$\Delta N_{be}$ is the digital representation of the second voltage; and m is a constant scaling factor determined based on at least an operating temperature of the reference voltage generator and process parameters associated with the reference voltage generator.

8. The reference voltage generator of claim 1, wherein the processing device comprises a digital processing module configured to:

compute a digital representation of a predetermined reference voltage based on the digital representations of the first and second voltages; and determine an error based on a digital representation of the reference voltage and the computed digital representation of the predetermined reference voltage.

9. The reference voltage generator of claim 8, wherein the processing device is configured to control the DAC to generate the reference voltage based on the error.

10. The reference voltage generator of claim 1, further comprising:

an analog to digital converter (ADC), wherein a gain of the ADC is a function of the reference voltage, wherein the processing device is configured to compare a predetermined value with the value to generate an error, and wherein the processing device is configured to control the DAC to generate the reference voltage based on the error.

11. The reference voltage generator of claim 1, further comprising circuitry configured to control a current used to generate at least one of the first and second voltages using the reference voltage.

12. A method of generating a reference voltage, comprising:

determining, by a processing device, a value based on digital representations of first and second voltages, and a digital representation of a reference voltage; and generating, by a digital to analog converter (DAC), the reference voltage based on the determined value;

wherein the first voltage is proportional to absolute temperature (PTAT) and the second voltage is complementary to absolute temperature (CTAT), wherein the reference voltage is substantially independent of absolute temperature in a predetermined temperature range; and wherein the reference voltage is fed back from the DAC to the processing device.

13. The method of claim 12, further comprising:

measuring the first voltage as a voltage across first and second terminals of a semiconductor device when the semiconductor device receives a first current; and measuring a third voltage as a voltage across the first and second terminals of the semiconductor device when the semiconductor device receives a second current;

wherein the second voltage is a difference between the third and first voltages.

14. The method of claim 12, wherein the generating comprises:

computing a digital representation of a predetermined reference voltage based on the digital representations of the first and second voltages;

determining an error based on a digital representation of the reference voltage and the computed digital representation of the predetermined reference voltage;

generating the reference voltage based on the error.

15. The method of claim 12, wherein the digital representations of the first and second voltages are generated using an analog to digital converter, further comprising:

controlling a gain of the analog to digital converter using the reference voltage;

wherein the generating comprises:

determining an error based on a predetermined value and a digital representation of the reference voltage;

generating the reference voltage based on the error.

16. The method of claim 12, further comprising:

controlling a current used to generate at least one of the first and second voltages using the reference voltage.

17. A non-transitory computer readable medium carrying one or more sequences of one or more instructions for execution by one or more processors to perform a method for generating a reference voltage, execution of the instructions by the one or more processors causing the one or more processors to:

determine, by a processing device, a value based on digital representations of a first and second voltages, and a digital representation of a reference voltage; and generate, by a digital to analog converter (DAC), a the reference voltage based on the determined value;

wherein the first voltage is proportional to absolute temperature (PTAT) and the second voltage is complementary to absolute temperature (CTAT), wherein the reference voltage is substantially independent of absolute temperature in a predetermined temperature range; and wherein the reference voltage is fed back from the DAC to the processing device.

18. The non-transitory computer readable medium of claim 17, wherein execution of the instructions by the one or more processors further causes the one or more processors to:

measure the first voltage as a voltage across first and second terminals of a semiconductor device when the semiconductor device receives a first current; and measure a third voltage as a voltage across the first and second terminals of the semiconductor device when the semiconductor device receives a second current;

wherein the second voltage is a difference between the third and first voltages.

19. The non-transitory computer readable medium of claim 17, wherein execution of the instructions by the one or more processors to generate the reference voltage further comprises causing the one or more processors to:

compute a digital representation of an ideal reference voltage based on the digital representations of the first and second voltages;

determine an error based on a digital representation of the reference voltage and the computed digital representation of the ideal reference voltage; and generate the reference voltage based on the error.

20. The non-transitory computer readable medium of claim 17, wherein the digital representations of the first and second voltages are generated using an analog to digital converter;

wherein execution of the instructions by the one or more processors further causes the one or more processors to control a gain of the analog to digital converter using the reference voltage; and wherein execution of the instructions by the one or more processors to generate the reference voltage further comprises causing the one or more processors to:

determine an error based on a predetermined value and a digital representation of the reference voltage; and generate the reference voltage based on the error.

21. The non-transitory computer readable medium of claim 17, wherein execution of the instructions by the one or more processors further causes the one or more processors to:

control a current used to generate at least one of the first and second voltages using the reference voltage.

* * * * *